US005257704A

United States Patent [19]

Gutt

[11] Patent Number: 5,257,704

[45] Date of Patent: Nov. 2, 1993

[54] TAMPERPROOF LIPSTICK SEAL

[75] Inventor: Edward S. Gutt, Maplewood, N.J.

[73] Assignee: Revlon Consumer Products Corporation, New York, N.Y.

[21] Appl. No.: 880,385

[22] Filed: May 8, 1992

[51] Int. Cl.[5] ..... B65D 41/54; B65D 65/32; A45D 40/12

[52] U.S. Cl. ..... 215/246; 215/230; 215/232; 215/251; 206/385; 206/497; 401/61; 401/68; 132/320

[58] Field of Search ..... 215/246, 230, 232, 251, 215/274; 206/385, 497; 401/61, 68, 74; 132/318, 320

[56] References Cited

U.S. PATENT DOCUMENTS

| | | | |
|---|---|---|---|
| 2,027,921 | 1/1936 | Marcus | 206/385 |
| 2,595,403 | 5/1952 | Neuschaefer . | |
| 2,770,358 | 11/1956 | Keith . | |
| 2,840,230 | 6/1958 | Lerner . | |
| 3,698,551 | 10/1972 | Tomlinson | 206/459.5 X |
| 3,809,226 | 5/1974 | Ferrari | 206/229 |
| 3,912,079 | 10/1975 | Selchow, Jr. | 206/489 X |
| 4,018,640 | 4/1977 | Amberg | 215/246 X |
| 4,432,462 | 2/1984 | Newkirk . | |
| 4,538,740 | 9/1985 | Petersen, Jr. . | |
| 4,545,494 | 10/1985 | Sawicki . | |
| 4,633,648 | 1/1987 | Yeung | 215/246 X |
| 4,758,456 | 7/1988 | Muscala . | |
| 4,781,484 | 11/1988 | Goncalves . | |
| 4,813,801 | 3/1989 | Cardia | 206/385 X |
| 4,957,210 | 9/1990 | Kusz | 215/220 |

FOREIGN PATENT DOCUMENTS

| | | | |
|---|---|---|---|
| 2608134 | 6/1988 | France | 401/61 |

*Primary Examiner*—Allan N. Shoap
*Assistant Examiner*—Vanessa Caretto
*Attorney, Agent, or Firm*—Julie Blackburn

[57] ABSTRACT

A tamperproof lipstick seal comprising a rectangular laminate having affixed to one edge a pull tab which protrudes from the edge of the laminate, lipstick containers containing such a seal, and a method for preventing breakage of a lipstick bullet using the seals of the invention.

2 Claims, 1 Drawing Sheet

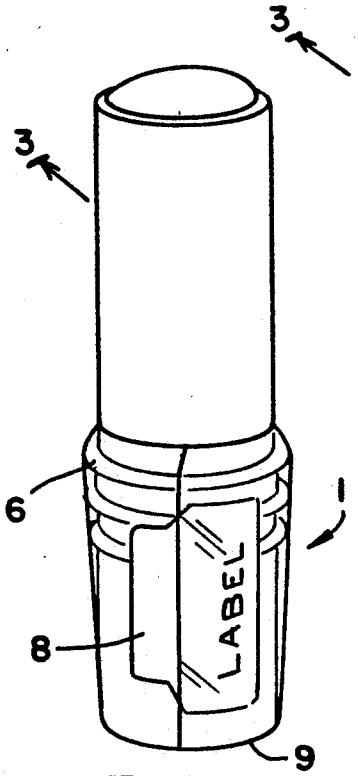
FIG. 1
FIG. 4
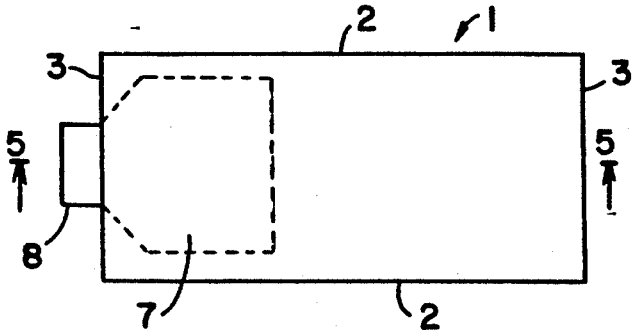
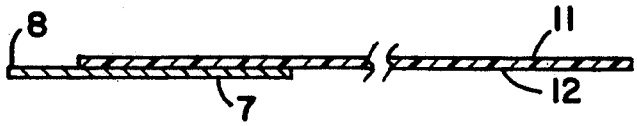
FIG. 5
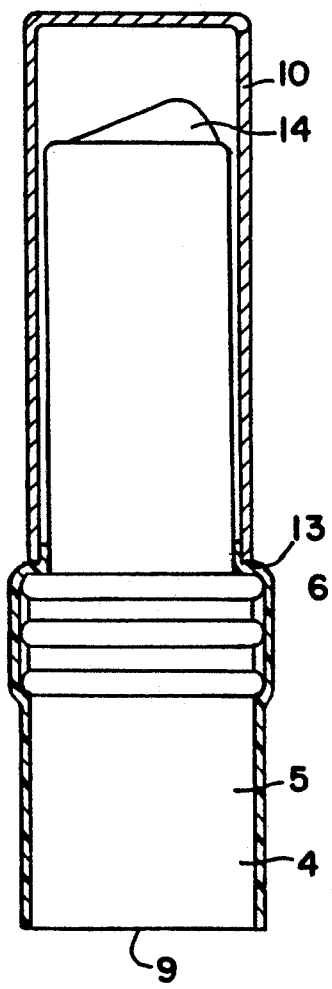
FIG. 3
FIG. 2
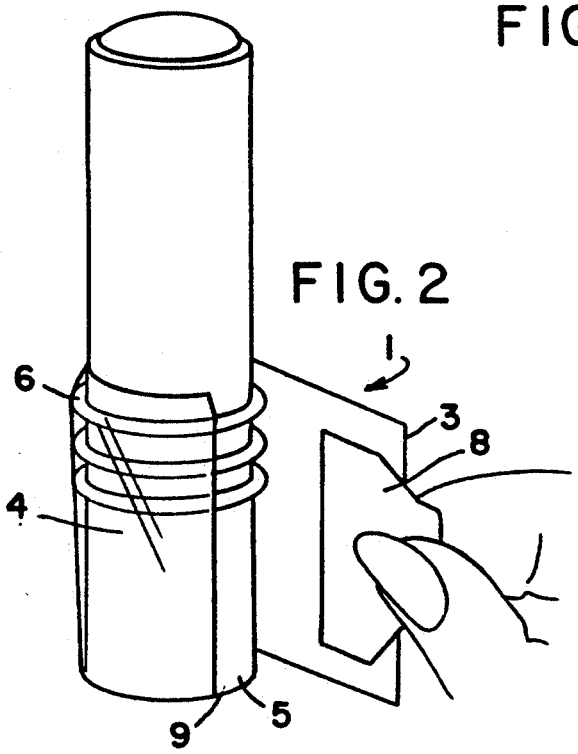

TAMPERPROOF LIPSTICK SEAL

TECHNICAL FIELD

The invention is in the field of tamperproof container seals.

BACKGROUND OF THE INVENTION

In recent years, it has become Particularly important to provide tamperproof or tamper evident seals on containers.

To cosmetics companies involved in the sale of lipsticks or lip glosses, stick breakage is a very costly problem. Lipstick buyers are very prone to testing lipsticks right at a cosmetics counter, and often wind up the lipstick bullet to observe color, then replace the cap without completely winding the bullet down. This results in breakage of the lipstick bullet, and the product is then returned to the manufacturer.

To the best of the inventor's knowledge, tamperproof seals have not been used on lipstick product containers, although many types of tamperproof seals exist. For example, a type of tamperproof seal commonly used on many non-lipstick type products is set forth in U.S. Pat. No. 4,758,456. This seal is a rectangular laminate comprised of a plastic such as polyvinyl chloride, coated with a pressure sensitive adhesive. A narrow pull tab runs across the middle of the seal. The seal is applied to the container via the pressure sensitive adhesive. The pull tab, which resembles a zipper, is removed after purchase and the product container may be opened.

This seal has a number of disadvantages when considered for use in lipsticks. First, the adhesive laminate remains adhered to the container after removal of the pull tab, providing a less than aesthetically pleasing look to the lipstick container. Second, the consumer is unable to remove the top of the lipstick container to study the shade without removing the pull tab entirely, thus "opening" the product, and making it unsuitable for sale to another. Third, there is no convenient area for the placing of a UPC code.

Thus there is a need for a tamperproof lipstick seal which overcomes these drawbacks.

SUMMARY OF THE INVENTION

The invention is directed to a tamperproof lipstick container seal comprising a rectangular laminate having affixed to one edge a paper tab which protrudes from the edge of the laminate to function as a pull tab.

The invention is directed to a lipstick container sealed with a tamperproof lipstick seal comprising a rectangular laminate having affixed to one edge a paper tab which protrudes from the edge of the laminate to function as a pull tab.

The invention is directed to a method for preventing lipstick breakage comprising applying to the lipstick container a tamperproof seal comprised of a rectangular laminate having affixed to one edge a tab which protrudes from the surface of the laminate to function as a pull tab, whereby the tamperproof seal permits the lipstick cover to be removed but does not permit the lipstick bullet to be wound up.

DESCRIPTION OF THE DRAWINGS

FIG. 1 illustrates a lipstick having its lid or cap removed, and wherein the tamperproof seal is placed around the base of the lipstick. The seal covers the portion of the lipstick container, or the rotational assembly, which rotates to permit raising of the lipstick bullet. The paper tab affixed to one edge of the rectangular laminate, protrudes from the side edge of the laminate to act as a pull tab easily gripped by the fingers when it is desired to remove the tamperproof seal.

FIG. 2 illustrates the base of a lipstick container and the mechanism by which the tamperproof seal is removed.

FIG. 3 illustrates a side sectional view taken across 3—3 of FIG. 1, of a complete lipstick container which has the tamperproof seal in place.

FIG. 4 illustrates a front view of the tamperproof seal of the invention.

FIG. 5 illustrates a side view of the tamperproof seal of the invention which shows the plastic laminate having attached at one edge the paper pull tab.

DETAILED DESCRIPTION

FIG. 4 illustrates the general configuration of the tamperproof seal 1 of the invention. It is rectangular in shape, and of dimensions suitable for placement on the base 5 of a lipstick container such that the upper and lower parallel sides or edges 2 of the rectangle are of a length sufficient so that the seal wraps once circumferentially around the lipstick base 5 (which is generally 2.0 to 2.2 inches in circumference), and the parallel side edges of the rectangle 3 are of a length sufficient to span from the bottom edge of the lipstick base 9 to the top of the circumferential band 6 which acts as a seat for the bottom most edge 13 of the lipstick cap 10 (generally a distance of about 1.15 to 1.3 inches). It is essential that the tamperproof seal completely secure the rotational assembly 4 which is used to raise the lipstick bullet 14 up and down. The rotational assembly 4 operates through rotation of the lipstick base 5 with the fingers of one hand, while holding the circumferential band 6 securely with the fingers of the other hand. As can be seen in FIGS. 1 and 2, the tamperproof seal completely secures the entire base 5 and circumferential band 6 both of which together constitute the rotational assembly 4.

At one edge of the tamperproof seal 1 is a pull tab 8. The pull tab 8 protrudes from the edge 3 of the seal and enables the consumer to remove the tamperproof seal from the lipstick container after purchase as set forth in FIG. 2.

The tamperproof seal may be made of polyvinyl chloride (PVC) or any other suitable plastic. The seal is generally of a laminate configuration comprised of a layer of plastic 11 coated on one side with a pressure sensitive adhesive 12. Generally, a clear, ultra violet resistant permanent acrylic adhesive is preferred, although other standard adhesives may be suitable. It is also preferred that the adhesive be heat shrinkable, since when applied to the container it provides a superior label. It is also generally preferred that the pull tab 8 be made of paper suitable for the printing of a UPC code. The placement of the pull tab containing the UPC code in this position enables easy scanning of the product.

FIG. 5 illustrates a side view of the seal which comprises a laminate of plastic 11 having on one side a layer of pressure sensitive adhesive 12. The pull tab 8 is adhered to the pressure sensitive adhesive 12.

FIG. 1 illustrates a lipstick container with its lid 10 removed, wherein a tamperproof seal 1 has been applied in accordance with the invention. It can be seen that the seal spans the area from the bottom most edge of the lipstick base 9 up to the top most edge of the circumferential rim 6 which acts as a seat for the bottom most edge 13 of the lipstick cap or lid 10. The placement of the seal 1 in this position allows for removal of the lipstick cap 10 to observe the color of the lipstick bullet 14, but prevents the consumer from operating the rotational assembly 4 to raise the lipstick bullet.

While the invention has been described in connection with the preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A lipstick bullet contained in a lipstick container comprised of a lipstick cover having a bottom most edge, and a rotational assembly comprised of a lipstick base having a bottom edge and a circumferential band having a top edge which top edge acts as a seat for the bottom most edge of the lipstick cover, said lipstick container having affixed thereto a tamperproof lipstick seal comprised of a rectangular laminate having upper and lower parallel edges and parallel side edges wherein the upper and lower parallel edges of the rectangular laminate are of a length sufficient that the rectangular laminate wraps once circumferentially around the rotational assembly and the parallel side edges of the rectangular laminate are of a length sufficient to span from the bottom edge of the lipstick base to the top edge of the circumferential band, wherein the rectangular laminate completely secures the rotational assembly against rotation, and said rectangular laminate has affixed to one parallel side edge a paper pull tab having printed thereon a UPC code, which protrudes from the parallel side edge of the rectangular laminate and enables complete removal of the rectangular laminate from the lipstick container.

2. The container of claim 1 wherein the tamperproof seal is heat shrinkably applied to the lipstick container.

* * * * *